US005258590A

United States Patent [19]

Dufournet et al.

[11] Patent Number: 5,258,590

[45] Date of Patent: Nov. 2, 1993

[54] MEDIUM- OR HIGH-TENSION CIRCUIT BREAKER HAVING ABUTTING ARCING CONTACTS

[75] Inventors: Denis Dufournet, Bron; Michel Perret, Bourgoin-Jallieu, both of France

[73] Assignee: GEC Alsthom SA, Paris, France

[21] Appl. No.: 920,842

[22] Filed: Jul. 28, 1992

[30] Foreign Application Priority Data

Aug. 2, 1991 [FR] France ..... 91 09887

[51] Int. Cl.[5] ..... H01H 33/88

[52] U.S. Cl. ..... 200/148 A; 200/148 R

[58] Field of Search ..... 200/148 R, 148 A, 148 B

[56] References Cited

U.S. PATENT DOCUMENTS 3,789,175 1/1974 Beier et al. ..... 200/148 R
3,854,019 12/1974 Handke ..... 200/148 R
3,855,437 12/1974 Goedecke et al. ..... 200/148 R

FOREIGN PATENT DOCUMENTS 382647 10/1931 Belgium .
946638 4/1951 Fed. Rep. of Germany .
2172980 10/1973 France .
327093 2/1958 Switzerland .
519773 2/1972 Switzerland .

*Primary Examiner*—J. R. Scott
*Attorney, Agent, or Firm*—Sughrue, Mion, Zinn, Macpeak & Seas

[57] ABSTRACT

The present invention relates to a medium- or high-tension circuit breaking having abutting arcing contacts and comprising a casing filled with a gas having good dielectric properties and containing a stationary first abutting contact and moving equipment including a first tube capable of being displaced by a drive rod and a semi-moving tubular second abutting contact. The annular end of the first tube carries a ring of contact arms that slide on the first abutting contact and that carry respective arcing contact blocks at their ends and respective permanent contact swellings proximate to the arcing contact blocks. A circuit breaker is thus provided which withstands the effects of arcing particularly well.

4 Claims, 2 Drawing Sheets

MEDIUM- OR HIGH-TENSION CIRCUIT BREAKER HAVING ABUTTING ARCING CONTACTS

The invention relates to a circuit breaker having abutting arcing contacts and suitable for use at medium- or high-tension.

BACKGROUND OF THE INVENTION

More precisely, the invention relates to a medium- or high-tension circuit breaker having abutting arcing contacts and comprising a casing filled with gas having good dielectric properties containing a stationary first abutting contact connected to a first current terminal, and moving equipment comprising a first tube capable of being displaced by a drive rod, said first tube being connected to a second current terminal, and co-operating with a second tube to define a blast volume and extended by a blast nozzle, said circuit breaker further including a semi-moving tubular second abutting contact receiving thrust at an annular end from a first end of a coil spring having its second end bearing against an annular shoulder of the first tube, the annular end of the second contact co-operating by abutment with an annular end of the first tube to open the abutting contacts.

Such circuit breakers with abutting arcing contacts are known in which the arc is blasted by gas being compressed during an opening operation. In those circuit breakers, gas compression takes place before the arcing contacts separate (precompression). During the precompression stage, the main contacts of the circuit breaker are opened, which main contacts may be disposed outside the casing. Such a circuit breaker is described in French Patent No. 2,661,549 and corresponding U.S. Pat. No. 5,162,627.

In those circuit breakers, with increasing short circuit currents, there appear high repulsive forces between the abutting contacts which thus tend to move apart, and which are thus rapidly damaged by arcing. To avoid this phenomenon, it is necessary to use a coil spring having a large compression force to withstand the repulsive forces. Unfortunately, this force acts on all of the moving parts of the apparatus constituted by the circuit breaker and its control mechanism, thus requiring equipment that is heavy and expensive.

The present invention seeks to solve this problem of repulsion between abutting contacts without increasing the compression force of the spring. In addition, because of the invention, the main contacts are integrated in the circuit breaker in a disposition that is simple and compact.

SUMMARY OF THE INVENTION

To do this, the annular end of the first tube carries a contact made up of a ring of contact arms sliding over the first abutting contact and carrying respective arcing contact blocks at their ends, and also carrying respective permanent contact swellings in the vicinity thereof, the longitudinal distance between the second abutting contact and its annular end being slightly greater than the sum of the lengths of one of said arms and the annular end to which it is secured.

In a preferred disposition, the outside diameter of the first abutting contact is slightly greater than the outside diameter of the second abutting contact.

Preferably, the arms are relatively flexible radially, and in the free state the inside diameters of the ring of blocks and of the ring of swellings are smaller than the outside diameter of the second contact; and the inside diameter of the ring of swellings is preferably slightly smaller than the inside diameter of the ring of blocks.

Also, the blocks are preferably made of an arc-resistant alloy.

The functions and advantages of these various features appear on reading the following description.

BRIEF DESCRIPTION OF THE DRAWINGS

An embodiment of the invention is described by way of example with reference to the accompanying drawings, in which.

DETAILED DESCRIPTION OF PREFERRED EMBODIMENT

Figure 1:
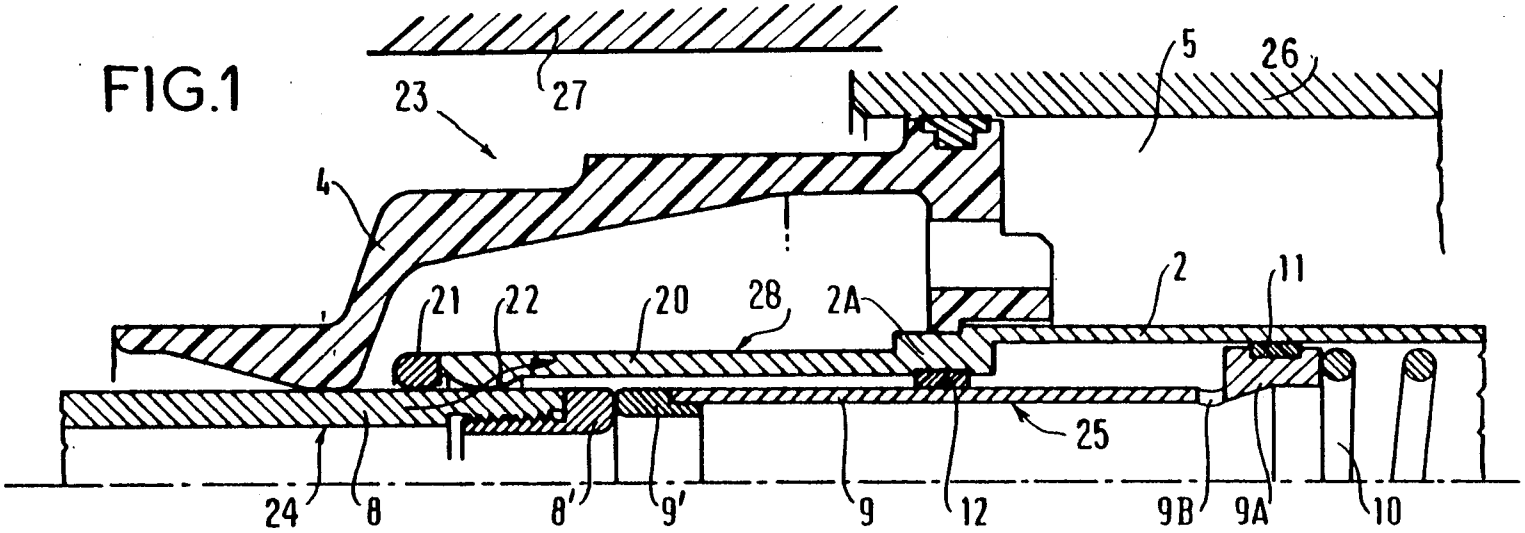
FIG. 1 is a fragmentary longitudinal section through a circuit breaker of the invention in the closed position.

Circuit breaker 23 includes a cylindrical casing 27 e.g. made of porcelain, which delimits a gastight inside volume filled with a gas having good dielectric properties, such as $SF_6$, on its own or mixed with nitrogen, and at a pressure of a few bars.

The stationary first abutting contact, indicated generally at 24, of the circuit breaker 23 is constituted by a metal tube 8 connected to a block passing through the casing in sealed manner and connected to a first current terminal. The end 8' of the tube 8 is made of an alloy that withstands the effects of arcing, e.g. a tungsten-based alloy.

The moving second abutting contact, indicated generally at 25, is constituted by a metal tube 9 whose end 9' co-operating with the contact 24 is likewise made of an arc-resistant alloy. Near its end opposite to the end 9', the tube 9 has a lateral opening 9B for evacuating gas. This end 9A is annular and larger in diameter than the remainder of the tube 9 and is slidably mounted in a tube 2.

The tube 2 is suitable for being displaced by a drive rod and it is connected to a second current terminal. It co-operates with a second tube 26 to define a blast volume 5 and it is extended by a blast nozzle 4.

The moving equipment is thus constituted by the tube 2 which is driven in translation, and by the second contact 25 which is semi-moving, being free to slide inside the tube 2 and receiving thrust at its annular end 9A via the end of a coil spring 10 whose second end bears against an annular shoulder of the tube 2.

The end of the tube 2 directed towards the stationary contact 24 includes an annular portion 2A which acts as an abutment to the radially enlarged annular end 9A of the semi-moving contact 25 to open the abutting contacts 24 and 25 as described in greater detail below during movement to the right, FIG. 4.

The annular end 9A is guided relative to the tube 2 by an insulating segment 11 and the annular end 2A is guided relative to the tube 9 by an insulating segment 12.

The annular end 2A carries a contact constituted by a ring 28 of contact arms 20 that slide on the fixed contact 24 via respective arcing contact blocks 21 and permanent contact swellings 22 disposed proximate to the arcing contact blocks 21.

According to important structural features whose function will be understood on reading the description of the operation of the circuit breaker:

the lengthwise distance between the second abutting contact 25 and its radially enlarged annular end 9A is slightly greater than the sum of the lengths of one of said arms 20 and the annular end 2A secured thereto;

the outside diameter of the tube 8 of first abutting contact 24 is slightly greater than that of tube 9 of the second abutting contact 25;

the arms 20 are resilient and are relatively flexible in the radial direction, and when unstressed, the inside diameters of the ring of blocks 21 and of the ring of swellings 22 are less than the outside diameter of tube 9 of the second contact 25; and the inside diameter of the ring of swellings 22 is slightly smaller than the inside diameter of the ring of arcing contact blocks 21.

The arcing contact blocks 21 are made of arc resistant material, e.g. based on tungsten, while the permanent contact swellings 22 are made of conventional conductive metal as are the arms 20.

The operation of the circuit breaker is now described in detail.

In the closed position as shown in FIG. 1, the abutting contacts 24 and 25 are in abutment, the swellings 22 are in contact with the side surface of the tube 8 of fixed contact 24 and the blocks 21 are lifted very slightly off said side surface. The permanent current as represented by an arrow flows from the first current terminal to the second current terminal via the tube 8, the swellings 22, the arms 20, and the tube 2.

Figure 2:
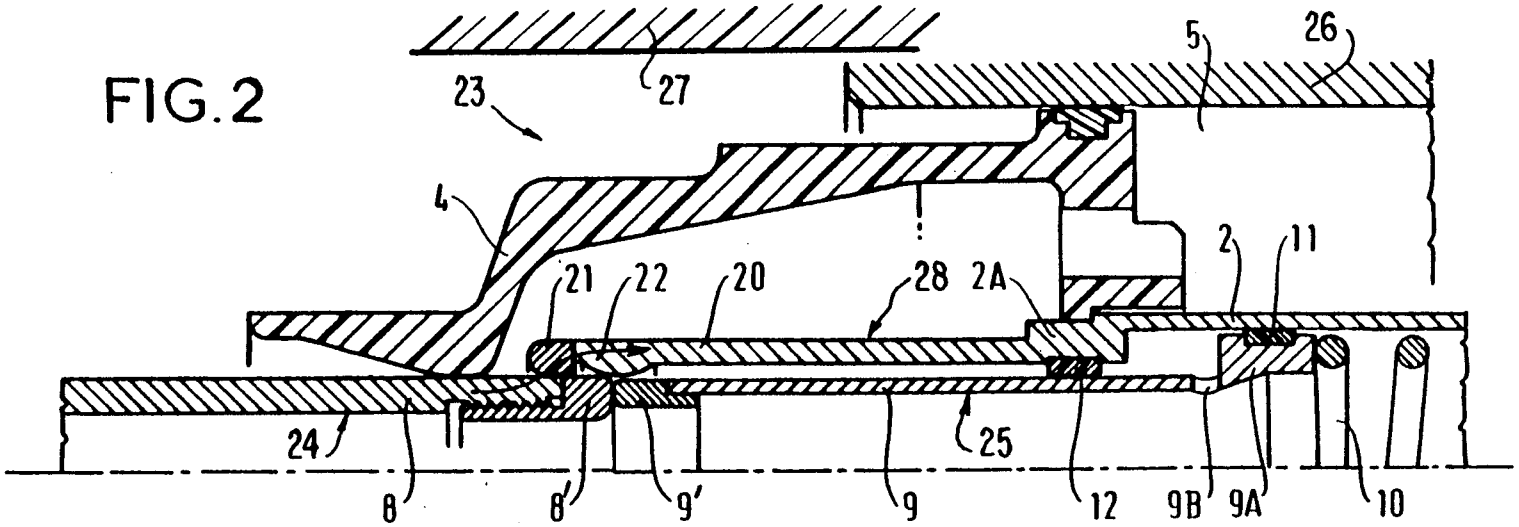
FIG. 2 is a fragmentary longitudinal section through a circuit breaker of the invention in an intermediate opening position.

In the intermediate position shown in FIG. 2, when the swellings 22 leave the side surface of the tube 8 of fixed contact 24 and given the dimensions specified above, there exists a small amount of clearance between the swelling 22 and the semi-moving contact 25, whereas the blocks 21 are in contact with the side surface of the fixed contact 24. The permanent current or the short circuit current represented by an arrow then flows from the first current terminal to the second current terminal via the tube 8, the blocks 21, and the tube 2.

Figure 3:
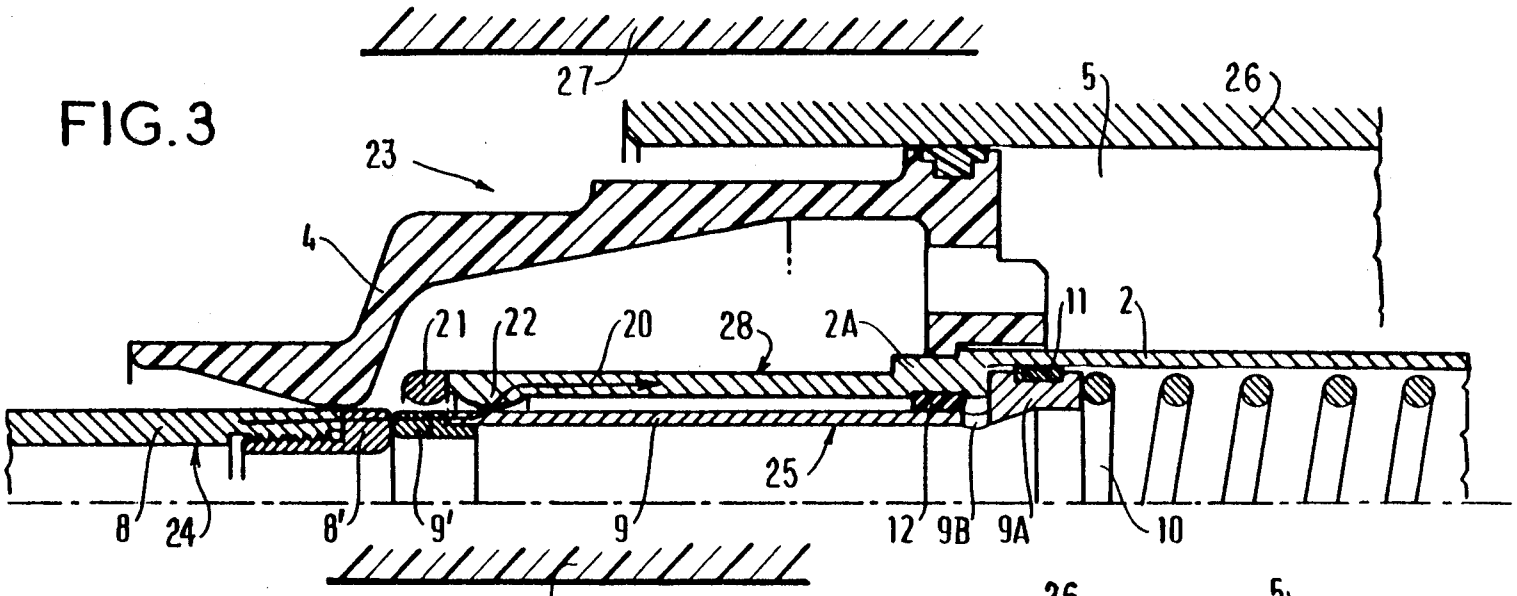
FIG. 3 is a fragmentary longitudinal section through a circuit breaker of the invention at a beginning-of-arcing position.

In the beginning-of-arcing position shown in FIG. 3, the annular end 2A comes into abutment with the annular end 9A, and given the dimensional dispositions specified above the blocks 21 are at a small distance from the fixed contact 24 which is still in abutment with the semi-moving contact. The current, represented by an arrow, then flows from the first current terminal to the second current terminal via the tube 8, the tube 9, the swellings 22, the arms 20, and the tube 2. If high short circuit currents are flowing and thus the resulting repulsive forces are also high, then the semi-moving contact 25 may move away without damage as shown by the dotted line. The arc struck between the end 8′ of the fixed contact 24 and the end 9′ of the semi-moving contact 25 is then transferred very quickly to between the end 8′ of the fixed contact 8 and the blocks 21 as soon as the distance between the abutting contacts 24 and 25 exceeds the distance between the fixed contact 24 and the blocks 21.

Figure 4:
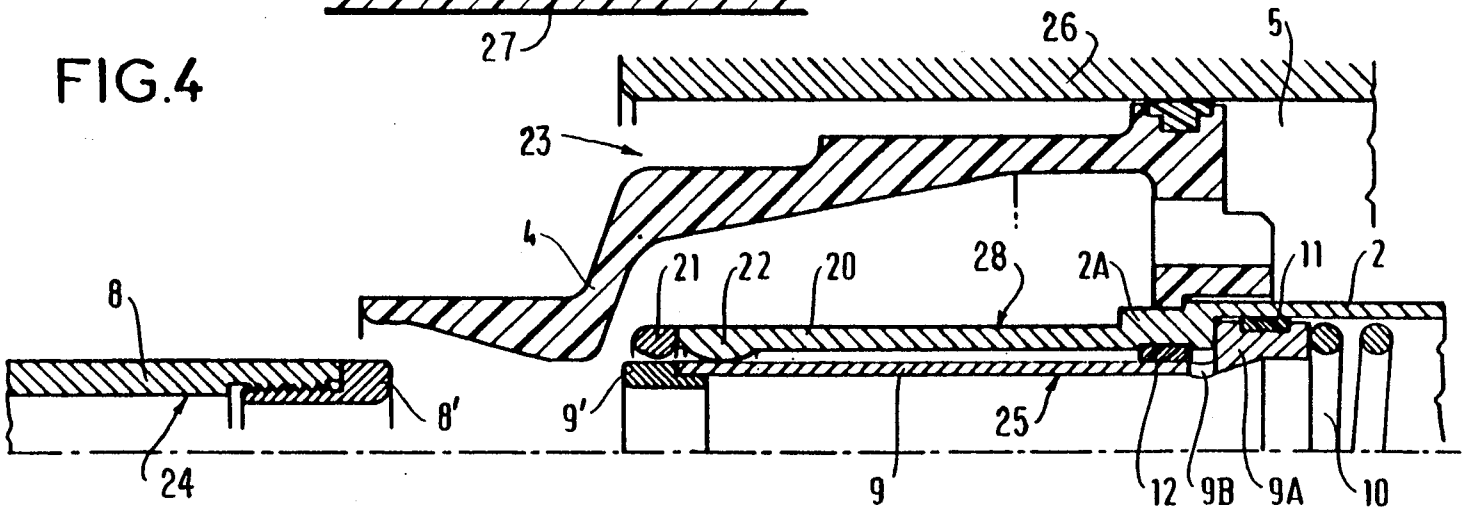
FIG. 4 is a fragmentary longitudinal section through a circuit breaker of the invention in its open position.

Opening is then terminated by the abutting contacts 24 and 25 separating, with the tube 2 entraining the semi-moving contact 25 as shown in FIG. 4.

The operation described above concerns opening. On closing, the movements are reversed.

Because of the invention, the problem caused by repulsion between the abutting contacts 24 and 25 is solved both on separation between said contacts on opening and on contact being made between said contacts on closing.

The circuit breaker could operate without abutting contacts, i.e. by omitting the tube 9, making use solely of a thimble of contact arms 20 as described above. The abutting contacts 24 and 25 make it possible to achieve rapid interruption with particularly short arcing times. Wear of the apparatus is thus reduced.

In addition, the blocks 21 made of arc-resistant alloy protect the metal (preferably copper) swellings 22 from the destructive effects of electric arcing, with the swellings 22 being designed to carry the permanent current.

We claim:

1. A medium- or high-tension circuit breaker comprising: a casing filled with gas having good dielectric properties and containing a stationary first abutting contact connected to a first current terminal, and moving equipment comprising a first tube capable of being displaced by a drive rod, said first tube being connected to a second current terminal, a second tube defining with said first tube a blast volume extended by a blast nozzle, said circuit breaker casing further containing a semi-moving tubular second abutting contact having an annular end, a coil spring having a first end in abutment with said annular end of said semi-moving tubular second abutting contact and having a second end thereof bearing against an annular shoulder of said first tube, said annular end of said semi-moving tubular second contact being positioned for abutment by an annular end of the first tube to open the abutting contacts during movement of said first tube in a direction away from said stationary first abutting contact, said annular end of said first tube carrying a ring of contact arms sliding over the first abutting contact and terminating in ends carrying arcing contact blocks, said ends of said arcing contacts also including respective permanent contact swellings in proximity to said arcing contact blocks, and said arcing contact blocks and said contact swellings being in sliding contact with said first and second abutting contacts, and wherein the longitudinal distance between the second abutting contact and the annular end thereof is slightly greater than the sum of the lengths of one of said arms and the annular end of the first tube to which said arms are secured.

2. A circuit breaker according to claim 1, wherein the outside diameter of the first abutting contact is slightly greater than the outside diameter of the second abutting contact.

3. A circuit breaker according to claim 2, wherein:

the arms are resilient and relatively flexible radially, such that in the free state of the arms, the inside diameters of the ring of blocks and of the ring of swellings are smaller than the outside diameter of the second contact; and the inside diameter of the ring of swellings is slightly smaller than the inside diameter of the ring of blocks.

4. A circuit breaker according to claim 1, wherein the arcing contact blocks are made of an arc-resistant alloy.

* * * * *